US008235783B2

(12) United States Patent
Jackson

(10) Patent No.: US 8,235,783 B2
(45) Date of Patent: Aug. 7, 2012

(54) WAGERING GAMES UTILIZING A PLAY OR PASS METHODOLOGY RELATED APPLICATION DATA

(75) Inventor: Kathleen Nylund Jackson, Scituate, MA (US)

(73) Assignee: WMS Gaming Inc., Waukegan, IL (US)

( * ) Notice: Subject to any disclaimer, the term of this patent is extended or adjusted under 35 U.S.C. 154(b) by 1241 days.

(21) Appl. No.: 12/008,900

(22) Filed: Jan. 15, 2008

(65) Prior Publication Data

US 2008/0171585 A1 Jul. 17, 2008

Related U.S. Application Data

(60) Provisional application No. 60/880,647, filed on Jan. 16, 2007.

(51) Int. Cl.
*A63F 9/00* (2006.01)

(52) U.S. Cl. ..... 463/16

(58) Field of Classification Search ..... None
See application file for complete search history.

(56) References Cited

U.S. PATENT DOCUMENTS

| | | | | |
|---|---|---|---|---|
| 5,294,120 | A * | 3/1994 | Schultz | 463/13 |
| 5,356,140 | A * | 10/1994 | Dabrowski et al. | 463/12 |
| 5,511,781 | A | 4/1996 | Wood et al. | 463/13 |
| 5,531,441 | A * | 7/1996 | Dabrowski et al. | 463/12 |
| 5,564,700 | A * | 10/1996 | Celona | 463/27 |
| 6,065,753 | A * | 5/2000 | Morosky | 273/292 |
| 6,146,271 | A * | 11/2000 | Kadlic | 463/13 |
| 6,206,373 | B1 * | 3/2001 | Garrod | 273/292 |
| 6,270,409 | B1 | 8/2001 | Shuster | 463/20 |
| 6,273,424 | B1 | 8/2001 | Breeding | 273/292 |
| 6,312,334 | B1 | 11/2001 | Yoseloff | 463/25 |
| 6,612,927 | B1 | 9/2003 | Slomiany et al. | 463/16 |
| 6,637,747 | B1 * | 10/2003 | Garrod | 273/292 |
| 6,652,378 | B2 | 11/2003 | Cannon et al. | 463/20 |
| 6,705,943 | B2 * | 3/2004 | Awada | 463/13 |
| 6,852,030 | B2 | 2/2005 | Baerlocher et al. | 463/25 |
| 6,860,810 | B2 | 3/2005 | Cannon et al. | 463/20 |
| 6,913,531 | B1 * | 7/2005 | Yoseloff | 463/13 |
| 6,932,703 | B1 | 8/2005 | Ritchie | 463/20 |
| 6,939,224 | B2 | 9/2005 | Palmer et al. | 463/16 |
| 7,008,319 | B2 * | 3/2006 | Montgomery et al. | 463/21 |
| 7,059,965 | B2 * | 6/2006 | Jackson | 463/16 |

(Continued)

*Primary Examiner* — Melba Bumgarner
*Assistant Examiner* — Seng H Lim
(74) *Attorney, Agent, or Firm* — Nixon Peabody LLP

(57) ABSTRACT

A monitor screen is provided on which symbols may be provided for use in video wagering games, including poker games, card games, slot games, bingo and keno. The player makes a wager to purchase a block of sequentially-playable games. The wager is the aggregate total of the wagers placed on each individual game. This aggregate total wager becomes the wager for the first game. A first partial (or intermediate) outcome of the first game is displayed. The player, having certain information about the potential final outcome from the partially displayed outcome, may choose to either: (a) play the partial first game to a final conclusion, or (b) pass by forfeiting the wager for the individual game. If the player decides to play the first game to its conclusion, the player will either lose the aggregate total wager, or win according to a predetermined paytable, in either case terminating any further play of the remaining games. If the player passes, the individual game wager is forfeited, and the partial outcome of the next sequential game in the block is displayed. The wager on this next or second game is the aggregate total wager minus the first single game wager. The process is repeated, subtracting individual passed game wagers from the aggregate total wager, until the player plays a game to its conclusion.

19 Claims, 9 Drawing Sheets

U.S. PATENT DOCUMENTS

| | | | | |
|---|---|---|---|---|
| 7,111,845 | B2 | 9/2006 | Walker et al. | 273/292 |
| 7,246,799 | B2 * | 7/2007 | Snow | 273/292 |
| 7,338,362 | B1 * | 3/2008 | Gallagher | 463/13 |
| 7,367,562 | B2 * | 5/2008 | Scheb et al. | 273/274 |
| 7,717,785 | B2 * | 5/2010 | Odom | 463/19 |
| 7,841,933 | B2 * | 11/2010 | Maul | 463/16 |
| 2001/0046890 | A1 * | 11/2001 | Ferguson | 463/13 |
| 2003/0022709 | A1 * | 1/2003 | Awada | 463/12 |
| 2003/0114209 | A1 * | 6/2003 | Ritner et al. | 463/11 |
| 2004/0009806 | A1 * | 1/2004 | Odom | 463/19 |
| 2004/0014522 | A1 * | 1/2004 | Walker et al. | 463/25 |
| 2004/0102235 | A1 | 5/2004 | Berman | 463/16 |
| 2004/0198481 | A1 | 10/2004 | Herrington et al. | 463/13 |
| 2004/0204214 | A1 * | 10/2004 | Tucci | 463/13 |
| 2004/0204228 | A1 | 10/2004 | Walker et al. | 463/20 |
| 2004/0204235 | A1 * | 10/2004 | Walker et al. | 463/29 |
| 2005/0035552 | A1 | 2/2005 | Ibbertson et al. | 273/292 |
| 2005/0059452 | A1 * | 3/2005 | Hartl | 463/13 |
| 2006/0025207 | A1 | 2/2006 | Walker et al. | 463/25 |
| 2006/0211468 | A1 | 9/2006 | Flint et al. | 463/16 |
| 2007/0155462 | A1 * | 7/2007 | O'Halloran et al. | 463/16 |
| 2007/0225067 | A1 * | 9/2007 | Olson | 463/25 |
| 2007/0281781 | A1 * | 12/2007 | Kennedy | 463/25 |
| 2008/0026826 | A1 * | 1/2008 | Groswirt | 463/25 |
| 2008/0139267 | A1 * | 6/2008 | Jackson | 463/12 |
| 2009/0093297 | A1 * | 4/2009 | Seelig et al. | 463/20 |
| 2009/0124337 | A1 * | 5/2009 | Lyons et al. | 463/20 |
| 2010/0167815 | A1 * | 7/2010 | Gagner et al. | 463/25 |

* cited by examiner

WAGERING GAMES UTILIZING A PLAY OR PASS METHODOLOGY RELATED APPLICATION DATA

RELATED APPLICATION DATA

This application claims priority from U.S. Provisional Application No. 60/880,647, filed Jan. 16, 2007.

BACKGROUND OF THE INVENTION

1. Field of the Invention

The present invention relates to electronic games suitable for use in casinos and other gaming enterprises. The invention further relates to video gaming play in which there is an intermediate outcome that provides a play or forfeit wager opportunity.

2. Background of the Art

Gaming machines, whether providing video poker or slot games, have grown exponentially in numbers in the last twenty years, as have the revenues generated by such devices. It is estimated that more than 75% of any casino's revenue is now provided by gaming machines as opposed to table games.

Machine manufacturers are constantly striving to capture the casino patron's attention with unique products and features that will initially attract and then keep the player at the machine. Advances in technology combined with the casino patrons' expectations have resulted in a burgeoning variety of gaming products. Players now have seemingly endless choices of the types of machine games (slots, video poker, keno, bingo and the like), technology (electromechanical traditional reels or video reels), denominations (from pennies to $1000 per play) as well as gameplays and special features. Players can choose between playing a stand-alone single machine or a networked machine that is capable of providing life-changing payouts. Some of the latest technology even allows competition between players on individual machines.

One of the most exciting gameplay features enables the player to make choices that can affect the game's outcome. Although the player may exercise decision-making techniques, the games are still random events with random outcomes. Video poker is most frequently associated with the ability to thus strategize, and video poker players can improve their overall win/loss percentages by using optimum play choices during the hold/draw stage.

Another popular feature allows for multiple wagers to be made simultaneously, thereby increasing casino profits, but providing the player with more chances to win and/or win larger amounts.

Previous art has attempted to provide decision-making elements in different and exciting ways while at the same time encouraging multiple or larger wagers.

U.S. Pat. No. 7,111,845 (Walker, et al.) describes a method and apparatus of playing a game that provides a player with at least one option for playing at least one round of the game in accordance with at least one advantage and/or disadvantage. For example, a player may agree to play a current round of play and/or at least one future round of play in accordance with a revised rule.

U.S. Pat. No. 6,939,224 (Palmer, et al.) describes an invention that provides a processor controlled gaming device having a display device in communication with the processor. When the display device receives an input from the player, the gaming device randomly generates an outcome, the display device displays an event having the outcome and the gaming device provides the player with a payout in association with the outcome and the selected input. The inputs have paytables that vary in range. One input has a large, risky payout range with big and small payouts. One input has a small, conservative payout range with intermediate payouts. Other inputs have ranges that fall in between the risky and conservative ranges. Each of the ranges has the same overall expected value, so that gaming device does not favor the player's choice of a risky or conservative input.

U.S. Pat. No. 6,932,703 (Ritchie) describes a slot machine game that simulates a bank robbery, having a vault mechanical assembly that includes a plurality of doors and gates that may be sequentially opened by attaining winning outcomes at successive levels of the game. Upon completion of each level of the game, the game allows the player to either risk the player's winning and proceed to the next level or "cash out," thereby adding excitement to the game.

U.S. Pat. Nos. 6,860,810 and 6,652,378 (Cannon, et al.) teach a gaming machine that is configured for mutually concurrent play of a plurality of games of chance on a single display screen. A method of conducting a wagering activity includes providing a player with a plurality of differing games of chance, at least some of which are mutually concurrently payable on a single screen display of a gaming device and enabling mutually concurrent play of the plurality of differing games of chance on the single screen display.

U.S. Pat. No. 6,852,030 (Baerlocher, et al.) discloses a gaming device and preferably a bonus round game of a gaming device that provides an offer/acceptance game, wherein the player preferably knows all the necessary information to make an informed decision whether to risk a currently held award and attempt to obtain a higher value award. The game determines the success or failure of a game event regardless of whether the player risks the offer award. If the player keeps an offer award, the game still displays a success or failure outcome, so that the player can see what the player missed, good or bad. The game also includes a plurality of levels or offers, wherein the player can sequentially trade up a currently held offer award a plurality of preferably predetermined times. The game is preferably embodied in a plurality of sequentially more difficult motorcycle jumps.

U.S. Pat. No. 6,612,927 (Slomiany, et al.) describes a game comprised of a plurality of stages. Each operation of the game begins with the operation of a first stage. Depending on the outcome of the first stage the game may be over, or there may be an operation of a second stage. Depending on the outcome of the second stage, the game may be over or there may be an operation of another stage. This sequence continues until the game ends or until the final ($n^{th}$) stage has been operated, at which time the game ends. Wagers are made on successive stages of the multi-stage game. Each stage of the game may typically have its own paytable or payout scheme, and its own expected return. A bet made on a stage of the game which is not played is lost in the preferred form of the invention. One embodiment is a three stage, multi-line, multi-coin video slot machine. The same game format (slots) with the same paytable is operated on three stages, with increasing payout multipliers at each stage providing an increasing amount to win at the higher stages. The "spin" at each stage is independent of the previous stages. The second embodiment is a multi-stage Five-Card Stud poker game. Each stage is again independent of the previous stage. A variation of this game is also shown which uses the same paytable on each stage, but combined with a mechanism to increase the "hit" rate. A third embodiment is a Draw poker game that combines the concepts of the Stud poker embodiment with the decisions and optimal play analysis that are integral to Draw poker. The fourth embodiment is a dice game which has been adapted to provide a high dependency between the first stage and the next stages.

U.S. Pat. No. 6,312,334 (Yoseloff) teaches a method of playing a video wagering game, including at least a first and second segment, the method comprising the steps of: placing a wager to participate in a video wagering game; playing the first segment of the video wagering game; continuing play of the first segment until at least one predetermined condition has been met; assigning a payout based on at least one predetermined winning outcome of the first segment; playing the second segment of the video wagering game when the at least one predetermined condition has been met; wherein at least a portion of said payout of the first segment is used as a wager in a second segment video wagering game in which a visually different screen format is used in play of a different game in the play of the second segment; and after play of the second segment video wagering game, a second segment payout is assigned based on at least a predetermined outcome of play of the second segment video wagering game.

U.S. Pat. No. 6,273,424 (Breeding) discloses a method of playing a wagering game, such as a casino table game or video game, including a playing card wagering game method involving each player placing a multiple part bet, such as a two, a three or a four part bet. A certain position in the order of play is reached (such as with cards being dealt by the dealer, two face down to the dealer and three face down to each player), and the player is given an opportunity to withdraw at least one part of the multiple part bet from risk, although at least one part of the multiple part bet must remain at risk during the play of the game. Players inspect or "sweat" the value of their position in the game (such as evaluating their cards) and the dealer or the program for the game gives each player the choice of withdrawing or leaving a first part of the bet. Each player decides and the dealer or the software then allows the game to advance (e.g., the dealer then turns over one of the cards. Where there are more than two parts to the multiple part bets, the dealer or apparatus may again give each player the choice of withdrawing or leaving a second part of the bet. The players decide and the game may continue, with or without a repetition of potential withdrawal of another part, but less than all parts of the multiple parts of the bet. For example in a card game, the player's cards are shown, and all remaining bets, which were not withdrawn, are resolved.

U.S. Pat. No. 6,270,409 (Shuster) discloses an invention that is directed to a gaming method and apparatus wherein the participants are guaranteed to win a minimum amount after a fixed period of time or a predetermined number of games. Preferred embodiments of the instant invention include the determination of the parameters for the minimum win and controlling the gaming device, wherein determination of the parameters for the minimum win includes the determination of the win interval and the minimum guaranteed award amount for achieving the win interval. If a player achieves a win interval, the player can received a minimum guaranteed award amount or proceed to the next level of play. Play continues until the player achieves a winning combination or chooses to receive the minimum guaranteed award amount.

U.S. Pat. No. 5,511,781 (Wood, et al.) describes a system that is adaptable to any game where a player sequentially receives a number of elements having identifying characteristics, with certain combinations of elements defined to be winning combinations. After all or part of an initial set of elements is obtained, the system offers the player an award to stop play prior to receiving a final set of elements. The amount of the offer is preferably based, at least in part, upon the probabilities of obtaining a winning combination using the initial set of elements received by the player. In accepting the "stop play" offer, the play of the game may cease, with the player forfeiting the right to win an award based on the final winning combinations, or, in an alternate embodiment, play can continue with an award, if any, based upon a modified pay schedule. In one embodiment, a standard video poker game is modified whereby upon receiving the initial set of five cards, an expected (winning) value for those cards is calculated based upon a summation of the awards and probabilities associated with every available discard and draw combination. Prior to permitting discards and further draws, an offer is made to the player based upon this calculated value. If the award is accepted, several playing options can be made available, such as terminating play, continuing play to show the optimum strategy and the result that would have been thereby obtained, or continuing play using a modified award schedule.

United States Patent Application Number 20060211468 (Flint, et al.) describes a gaming system for playing a video poker game that includes a wager-input device, a display, and a controller. The wager-input receives a wager input from a player to purchase a plurality of poker hands, wherein the poker hands include a first hand and a second hand. The display displays a plurality of first cards as a first played hand of the first hand. The controller is coupled to the display and is programmed to create the second hand initially consisting of the plurality of first cards, if the first played hand is a predetermined ranked winning card combination. The controller is further programmed to allow the player to create a second played hand of the second hand. The second played hand includes at least one player-selected card of the first cards and at least one randomly selected card from a deck of cards.

United States Patent Application Number 20060025207 (Walker, et al.) provides systems and methods of allowing a player to play a gaming device and receive a predetermined number of outcomes in exchange for a payment. The gaming device generates at least the predetermined number of outcomes, and adjusts a balance of the player device based on the outcomes. The player can continue playing regardless of whether the balance is less than zero.

United States Patent Application Number 20050059452 (Hartl) discloses a video gaming system that provides a game of video draw poker or a variation thereof in which a player may withdraw exactly 40% or exactly 60% of any wager on any hand (surrendering 60% or 40% of the initial wager, respectively). The game may end upon the surrender, or the odds within the pay table may change with continued play of the game with the residual of the wager. In another variant, the player may withdraw a percentage of the original wager, have the initial pay table altered, and the game is allowed to continue.

United States Patent Application Number 20050035552 (Ibbertson, et al.) describes a game method for providing a mid-game wager for a base game including designating at least one intermediate game point and at least one qualifying intermediate holding corresponding to at least one qualifying final result. Players optionally place a base game wager and initiate the base game. The base game is played until an intermediate game point is reached. A player holding a qualifying intermediate holding at the intermediate game point may place an optional mid-game wager. The base game is played to completion. Players with a final holding that is a qualifying final result are rewarded based on the mid-game wager.

United States Patent Application Number 20040204228 (Walker, et al.) discloses a method for facilitating play of a gaming device, in which the method comprises enabling a reverse payout mode of play of the gaming device and displaying an indication that play of the gaming device is to be provided in accordance with the reverse payout mode of play. In some embodiments, the indication may include a representation of a virtual player playing in a normal mode of play.

United States Patent Application Number 20040198481 (Herrington, et al.) discloses a system and method of playing a video poker game by a player. The video poker game has a hand composed of a predetermined number of cards. The method includes the steps of displaying on a video screen a number of plurality of playing cards. The number of cards being greater than the predetermined number of cards. The player is given an opportunity to stop play and receive a payout as a function of a first pay table and any winning combination of cards in the plurality of playing cards. If the player does not stop play, a first number of the plurality of playing cards is deleted and a first remaining plurality of playing cards is displayed.

United States Patent Application Number 20040102235 (Berman) discloses a method and apparatus for aggregately playing multiple gaming activity events en masse, where the gaming activity events would otherwise require participation in a successive fashion. An aggregate play mode is initiated, and a number of gaming activity events to be associated with the aggregate play is identified. A random number set is generated for each gaming activity event included in the aggregate play, where each random number set corresponds to an individual payout result for its respective gaming activity event. A collective payout result is provided, which includes all of the individual payout results associated with the aggregate play.

It is an objective of this invention to provide players with new and enticing features that will stimulate player interest and increase time on the machine. In particular, the present invention seeks to provide the player with the opportunity to play multiple games in successive order while allowing the player to decide whether to play out a game to its conclusion or "pass" on that particular game and move on to the next game.

SUMMARY OF THE INVENTION

A monitor screen is provided on which symbols may be provided for use in video wagering games, including by way of non-limiting examples poker games, card games, slot games, bingo and keno. The player makes a first wager to purchase a defined or random number constituting a block of sequentially-playable hands (or games in the case of non-card-based games) to be played against a predetermined paytable. An additional side wager may or may not be required. The first wager is the aggregate total of the wagers placed on each individual hand. Preferably each individual hand wager is equal or automatically distributed among the number of sequential hands or games. For example, each hand of 10 hands (constituting a block) in 5-card draw poker game may cost $1.25, so the aggregate total wager would be $12.50 for the block of 10 hands. The said aggregate total wager becomes the wager for the first hand. A first (or intermediate) partial outcome of the first hand is displayed. In the example of the 5-card draw poker game, a first hand of 5 cards is dealt, with the wager at risk on this first hand being $12.50. Before a HOLD/DRAW stage, the player is given the opportunity to abandon the hand, or play the first hand to its conclusion. Having certain information about the potential final outcome from the partially displayed outcome, the player may choose to either: (a) play the partial first hand to a final conclusion, or (b) pass by forfeiting the wager ($1.25) for the individual hand. If the player decides to play the first hand to its conclusion, the player will either lose the aggregate total wager if a losing outcome is determined, or win according to a predetermined paytable if a qualifying outcome is determined, in either case terminating any further play of the remaining hands. If the player passes, the individual hand wager ($1.25) is forfeited, and the partial outcome of the next sequential hand in the block is displayed. The wager on this next or second hand is the aggregate total wager minus the first single hand wager (e.g., $11.25). Referring once again to the 5-card draw poker example, if the player receives poor cards in the first hand deal, the player may elect to forfeit $1.25 to abandon that hand before the hold/draw (called "PASS"). The player may indicate an intent to "PASS" by pressing a physical machine button or touchscreen area on the monitor or defaulting by exceeding a time interval. A second deal of 5 cards is shown immediately, dealt from a separate deck and replacing the cards in the first deal. The wager at risk on this second hand is $12.50 (aggregate total wager) minus the $1.25 forfeited on the first hand, or an amount of $11.25. The process is repeated, subtracting individual passed hand wagers from the aggregate total wager, until the player plays a hand to its conclusion. If there is only one hand left, that last hand must be played to completion. Preferably the paytable remains proportionally constant throughout the play of the block of hands, although it may be incremented or decremented according to the various rules that may be adopted in play of the game.

Those trained in the art will appreciate that these play options are exemplary and are not intended to dictate an exclusive method of play, nor limit or restrict specific gameplay. The play methods may be utilized with any standard video poker game versions, as well as with video slot games, bingo, keno and the like.

DETAILED DESCRIPTION OF THE INVENTION

Figure 1:
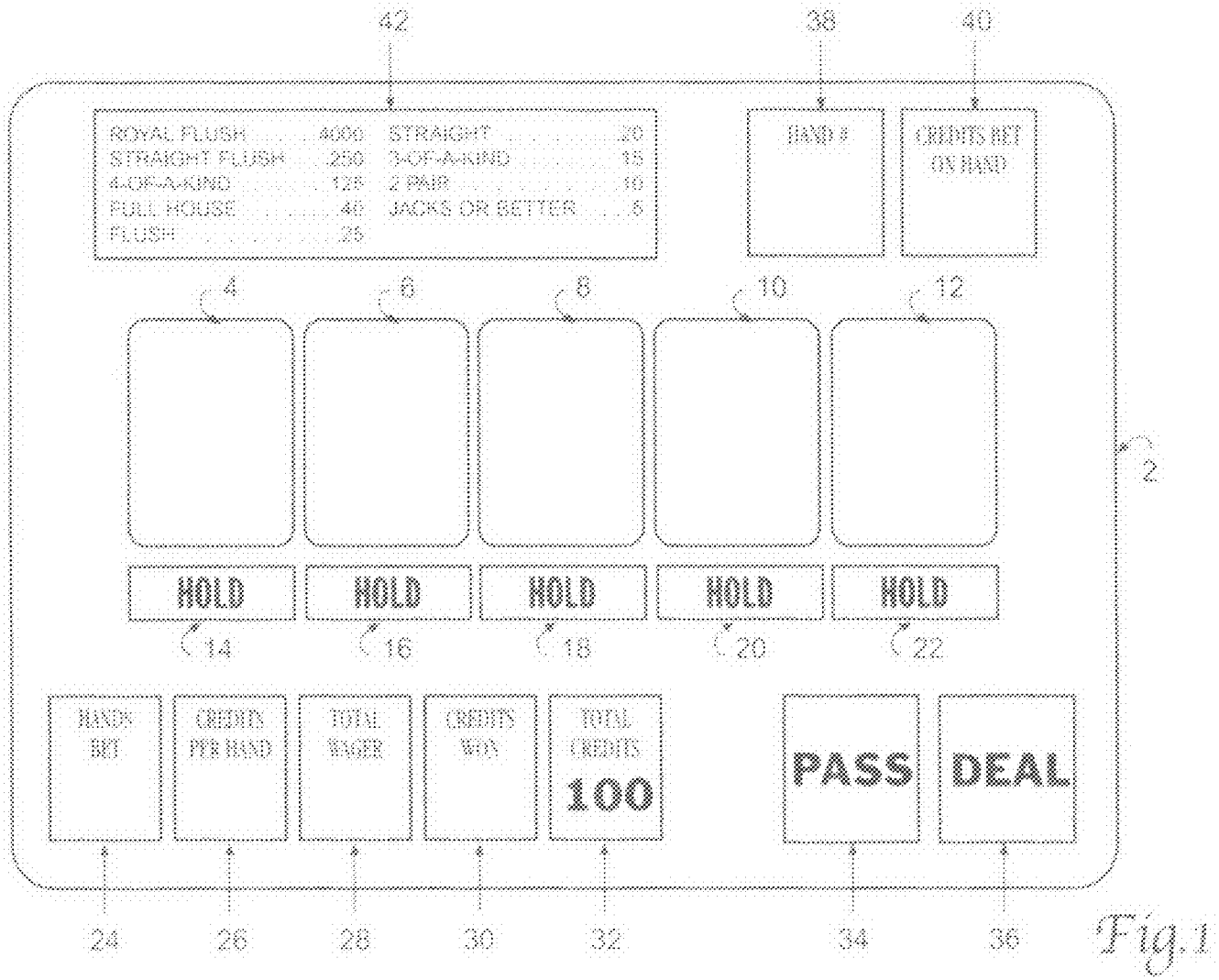
FIG. 1 shows a monitor screen of a video poker machine at rest, displaying the gameplay elements used in the present invention.

The present technology includes a method of playing an electronic wagering video game comprising: a player placing a first aggregate wager; the aggregate wager providing a set of a sequence of a number n of games to be played on a video wagering system; the aggregate wager being committed to play of a first game of the n number of games; the video game providing a partial outcome to the player on the first game; the player having an option of playing the first game to conclusion wagering the aggregate wager on an outcome of the first game or forfeiting a portion of the aggregate wager; and the player receiving a second partial outcome on a second game if the portion of the wager is forfeit while placing a remainder of the total aggregate at potential risk in the second game or playing the first game to conclusion with the entire aggregate wager at risk. The number n of games is provided by an activity selected from the group consisting of an automatic selection of n games, the player selecting a number n of games, and the electronic wagering game having a default number n. The number n may, by way of a non-limiting example, be between 2 and 10 inclusive. In a preferred embodiment, the wagering game comprises a poker game, such as a draw poker game wherein the partial outcome comprises 5 initially-dealt cards in a five card draw poker game. The aggregate wager may be apportioned equally among the n number of games, such that if the aggregate amount is Y, the portion that would be forfeit on the first game would be Y/n. The amount potentially at risk on a second game would be Y−Y/n. The player may be required to place a side bet wager on at least one of the n games. As the game progresses along the sequence of consecutive games or hands, the maximum amount the player could place at risk at any time would decrease by the amount forfeit in a previous hand. For example, if the aggregate amount that can possibly be wagered on the first hand or round is Y, after forfeiting the proportional wager of Y/n on the first hand or round, the portion that would be at risk on the second game if played to conclusion would be Y−Y/n. Because the game provides for a significant amount of player control over the wagering on hands or rounds with at least partial knowledge of the hand, knowledge of a significant chance of a favorable outcome and even with absolute knowledge that the hand will win (e.g., in a draw poker-type game, a two-card partial hand might be a winning pair or two Wild Cards, guaranteeing a win), other adjustments in the game may be desirable to secure a house advantage. For example, the initial aggregate wager might have to be Y+1, so that the individual proportional wagers would be still Y/n, but one unit of the wager would be immediately removed by the machine or the house to assure a favorable rate of retention or profit by the casino or machine. This may be referred to as an odds adjusting side bet in the art. A video wagering system enabling play of this game may comprise at least a processor and a video monitor, the processor operating the method described herein on the video monitor.

A monitor screen is provided on which symbols may be provided from a processor and database for use in video wagering games, including poker games, card games, slot games, bingo and keno. The player makes a wager to purchase a block of sequentially-playable games or hands (each of which and/or collectively) to be played against a predetermined paytable. A block is defined as at least two sequential games or hands, and may be a predetermined amount, a randomly chosen number or a number of games chosen by the player. An additional side bet may or may not be required to utilize the wagering methodology disclosed in the present invention. The first wager is the aggregate total of the wagers placed on each individual game. This aggregate total wager becomes the wager that in its entirety may be at risk for the first game. A first partial outcome of the first game is displayed. The player, having certain information about the potential final outcome from the partially displayed outcome, may choose to either: (a) play the partial first game to a final conclusion, or (b) pass by forfeiting the proportional amount of the first wager for the individual first game. If the player decides to play the first game to its conclusion, the player will either lose the aggregate total wager if a losing outcome is determined, or win according to a predetermined paytable if a winning outcome is determined, in either case terminating any further play of the remaining games. If the player passes (declines to stand or discard/draw), the individual game wager is forfeited, and the partial outcome of the next sequential game in the block is displayed. The wager (e.g., the second wager or second hand wager) on this next or second game is the aggregate total wager minus the first single individual game wager. The process is repeated for each game, subtracting individual game wagers for passed games, until the player plays a game to its conclusion and/or concludes the block or set of games or hands. The final game in the block must be played to its conclusion.

A first preferred embodiment of the present invention requires a wager to play a specific number (e.g., 2, 5 or 10) of 5-card video draw poker games. The player makes a first aggregate wager to purchase a block of at least two sequentially-playable hands. The amount of sequentially-playable hands may be predetermined, randomly assigned (e.g., with at least minimum of two games) or the player may be allowed to choose the number of hands to be played. The player may also choose the number of credits wagered on each hand, or the play may require a minimum to maximum bet. An additional side wager may or may not be required to participate in the game. The first wager is the aggregate total of the wagers placed on each individual hand and which preferably may be placed at risk (in total) in the first hand. Preferably each individual hand wager is equal. For example, each hand of 10 hands in 5-card draw poker game may cost $1.25, so the first wager would be $12.50 for the block of 10 hands. The said aggregate total wager becomes the wager for the first hand. A first initial hand of 5 cards is randomly dealt from a standard 52-card deck (or more cards with the inclusion of wild cards, jokers or special cards), with the wager at risk on this first hand potentially being $12.50. Before the HOLD/DRAW stage, the player is given the opportunity to abandon the hand (losing the proportional $1.25 wager), or to play the hand to its conclusion. Having certain information about the potential final outcome from the partially displayed outcome (the initial five card hand or a limited disclosure of the first five cards, such as 1, 2, 3 or 4 cards), the player may choose to either: (a) play the partial outcome of the first hand to a final conclusion, or (b) pass by forfeiting the wager for the individual hand. If the player decides to play the first hand to its conclusion, the player will either lose the aggregate total wager (or an elected partial amount of that aggregate wager, such as only the proportionate amount or a fixed minimum proportional amount, such as at least 20% or at least 50% of the aggregate wager) if a losing outcome is determined, or win according to a predetermined paytable if a qualifying outcome is determined. In either case, any further play of the remaining hands is terminated. If the player passes, the individual hand wager is forfeited, and the partial outcome of the next sequential hand in the block is displayed, with the remainder of the aggregate being wagered on the remaining hands of the original group of hands or games. The wager on this next or second hand is the aggregate total wager minus the first single hand wager forfeit by the pass. For example, if the player receives poor cards in the first hand deal, the player may elect to forfeit $1.25 to abandon that hand before the draw (called "PASS"). The player may indicate an intent to "PASS" by pressing a physical machine button or touchscreen area on the monitor or allowing maximum time to expire before making a decision. A second deal of 5 cards is shown immediately thereafter, dealt from a separate deck and replacing the cards in the first deal. The wager at risk on this second hand is $12.50 (aggregate total wager) minus the $1.25 forfeited on the first hand, or an amount of $11.25. The process is repeated, subtracting individual passed hand wagers from the aggregate total wager, until the player plays a hand to its conclusion. If there is only one hand left (after passing all but one (the last) hand), that last hand must be played to completion. Preferably the paytable remains proportionally constant throughout the play of the block of hands, although it may be incremented or decremented according to the rules of the game, such as ascending or descending in magnitude of the wager, or varying randomly.

A second preferred embodiment of the present invention requires a first aggregate wager to play a video slot game. The said video slot game consists of multiple spinnable reels having symbols displayed thereon, and preferably arranged in an adjacent order. The methodology is the same as in the first embodiment, except that blocks of slot games are wagered upon, as opposed to blocks of poker games. The games may or may not be the same basic game or theme. The intermediate outcome (or partial outcome) may be any outcome after the reels are spun that is not a final outcome. For example, after wagering to play 10 sequential slot games, the aggregate total wager is at risk on the first game. The reels spin, and only the first (or any number that is less than all frames in the payline) reel of five reels comes to a stop. The player then decides to PLAY or PASS according to the information gleaned from the displayed symbols on the first stopped reel. The game continues as in the first embodiment until a single individual game is played to its conclusion.

A third preferred embodiment of the present invention requires a wager to play a video keno game. As an example, the player may choose 20 numbers from the numbers 1 through 80, and may also choose the amount of numbers that may match a randomly-chosen machine array of 20 numbers. The methodology is the same as in the first embodiment, except that blocks of keno games are wagered upon. The intermediate outcome (or partial outcome) may be any outcome that is not a final outcome. For example, after wagering to play 10 sequential keno games, the aggregate total wager is at risk on the first game. The player has chosen to match 7 of the 20 player-chosen numbers to the 20 number randomly-chosen array. A partial outcome of 5 randomly-chosen numbers is displayed. The player then decides to PLAY or PASS according to the information gleaned from the displayed numbers. The game continues as in the first embodiment until a single individual game is played to its conclusion.

A fourth preferred embodiment of the present invention requires a wager to play a video bingo game. As an example, the player may play 10 sequential games of bingo, consisting of 1 bingo card in each game. The methodology is the same as in the first embodiment, except that blocks of bingo games are wagered upon. The intermediate outcome (or partial outcome) may be any outcome that is not a final outcome, such as declaring five numbers in a bingo call event. For example, after wagering to play 10 sequential bingo games, the aggregate total wager is at risk on the first game. A partial outcome of 5 randomly-chosen bingo numbers is displayed. The player then decides to PLAY or PASS according to the information gleaned from the displayed numbers. The game continues as in the first embodiment until a single individual game is played to its conclusion.

Reference to the Figures will assist in further understanding of the practice of the present invention.

FIG. 1 shows a video poker machine monitor screen 2 with a card area (4, 6, 8, 10, 12) for five standard playing cards. Five corresponding touchscreen HOLD buttons (14, 16, 18, 20, 22) are shown below the card area. Also shown are touchscreen/display wagering option buttons for the Number of Hands Bet 24, Credits Bet per Hand 26, Total Wager 28, Credits Won 30 and the player's Total Credits 32. Here the player is shown having 100 Total Credits 32. A PASS button 34 and a DEAL button 36 are shown on the monitor screen 2, as well as two areas for displaying the Hand # Being Played 38, and the Credits Being Bet 40 on that hand. A paytable 42 is shown, reflecting the payouts per 5-credit bet.

Figure 2:
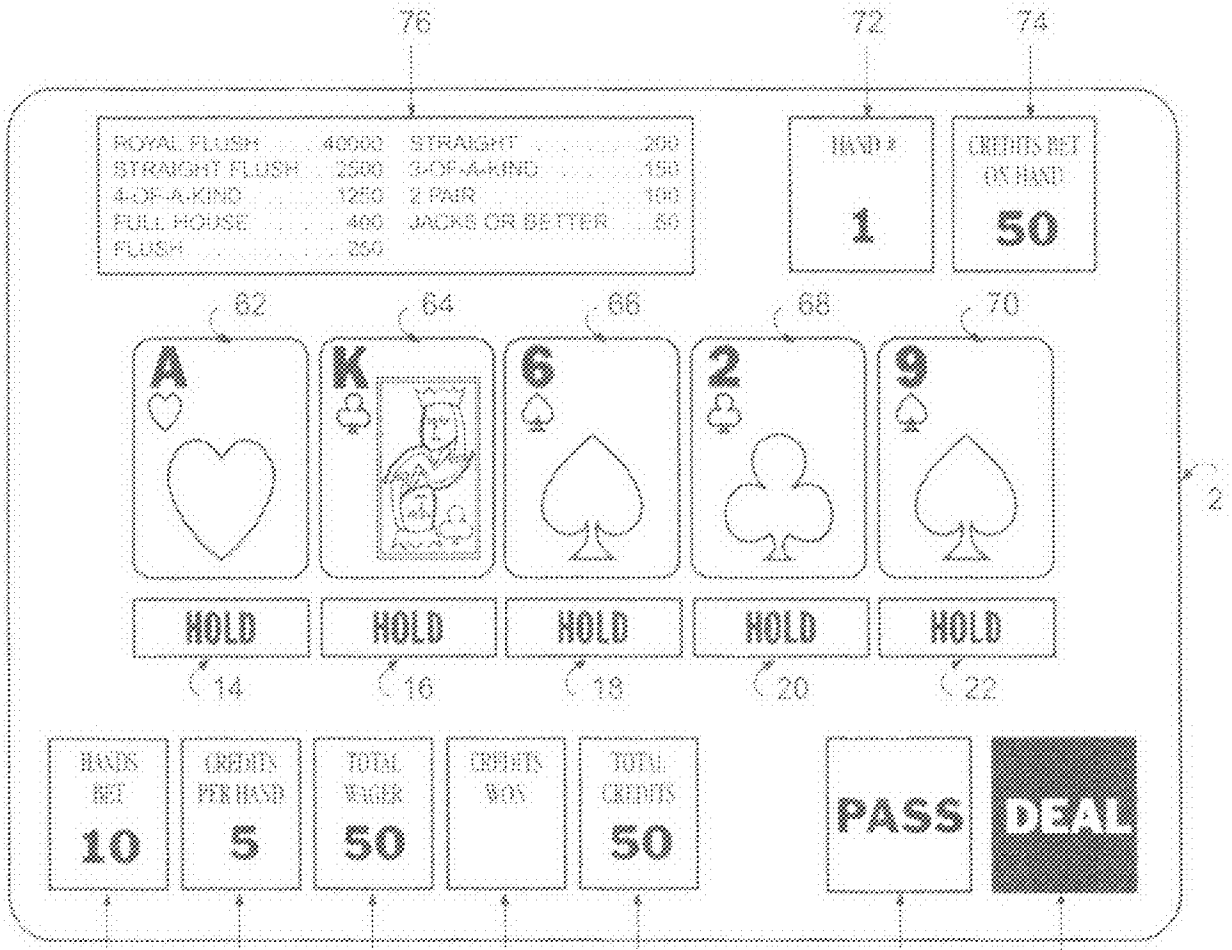
FIG. 2 shows the same game of FIG. 1 at a later stage.

FIG. 2 refers to the game elements shown in FIG. 1 with the display of the wagering option buttons showing Number of Hands Bet 50 as 10, at 5 Credits Bet per Hand 52, for a Total Wager 54 of 50 Credits. The player's Total Credits 58 after the wager is shown, with 50 credits still being available. The DEAL button is shown highlighted 60, which initiates the initial deal of 5 cards (62, 64, 66, 68, 70) from a first deck of 52 standard playing cards. The Hand # is displayed as 1 72, and the Credits Being Bet on this first hand are shown as 50 Credits 74. A new paytable 76 is shown, reflecting the payouts per 50-credit bet.

Figure 3:
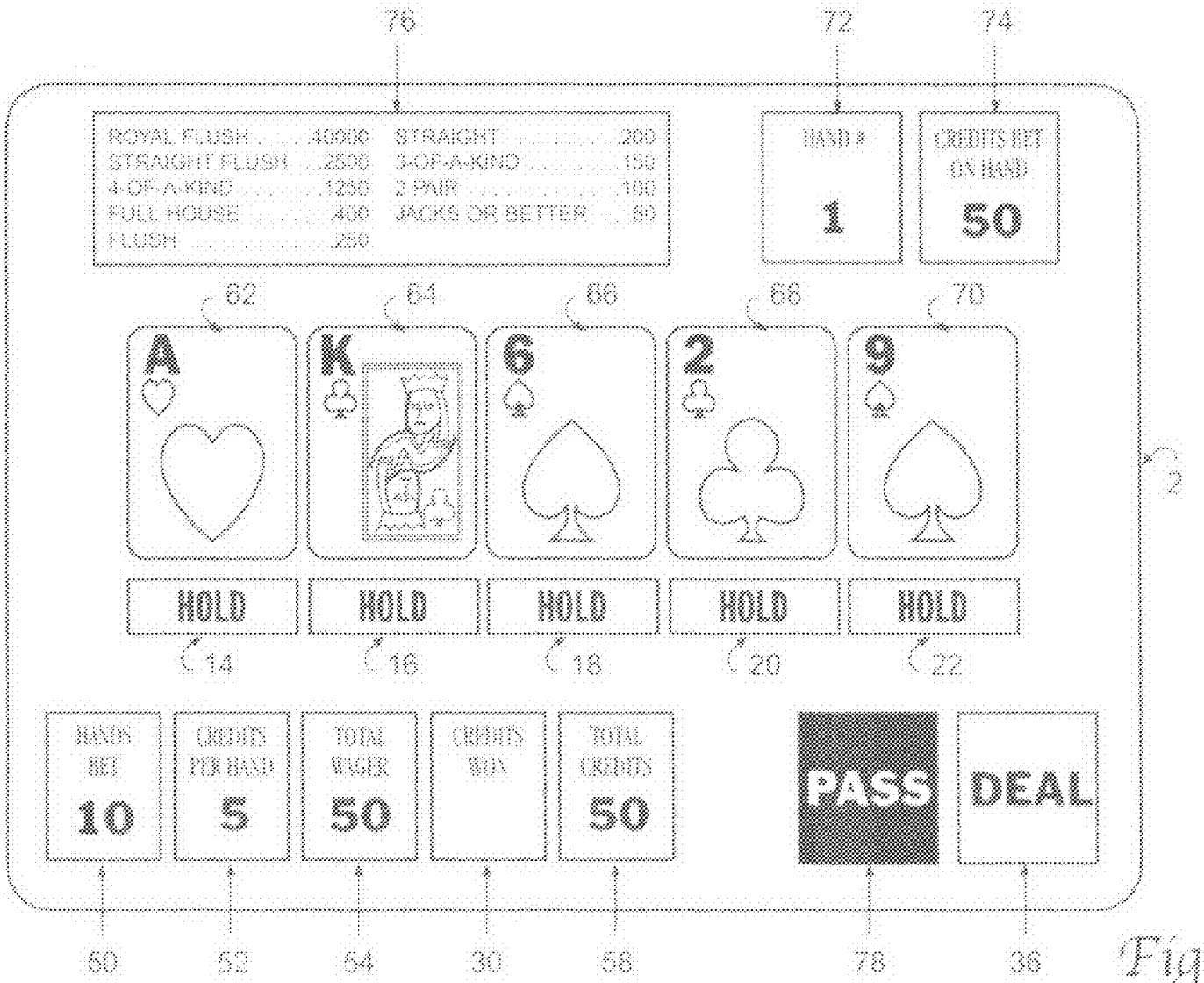
FIG. 3 shows the same game of FIG. 1 at a later stage.

FIG. 3 refers to the game elements shown in FIG. 2 with the PASS button being highlighted 78, indicating the player's choice to not play Hand #1 to a conclusion.

Figure 4:
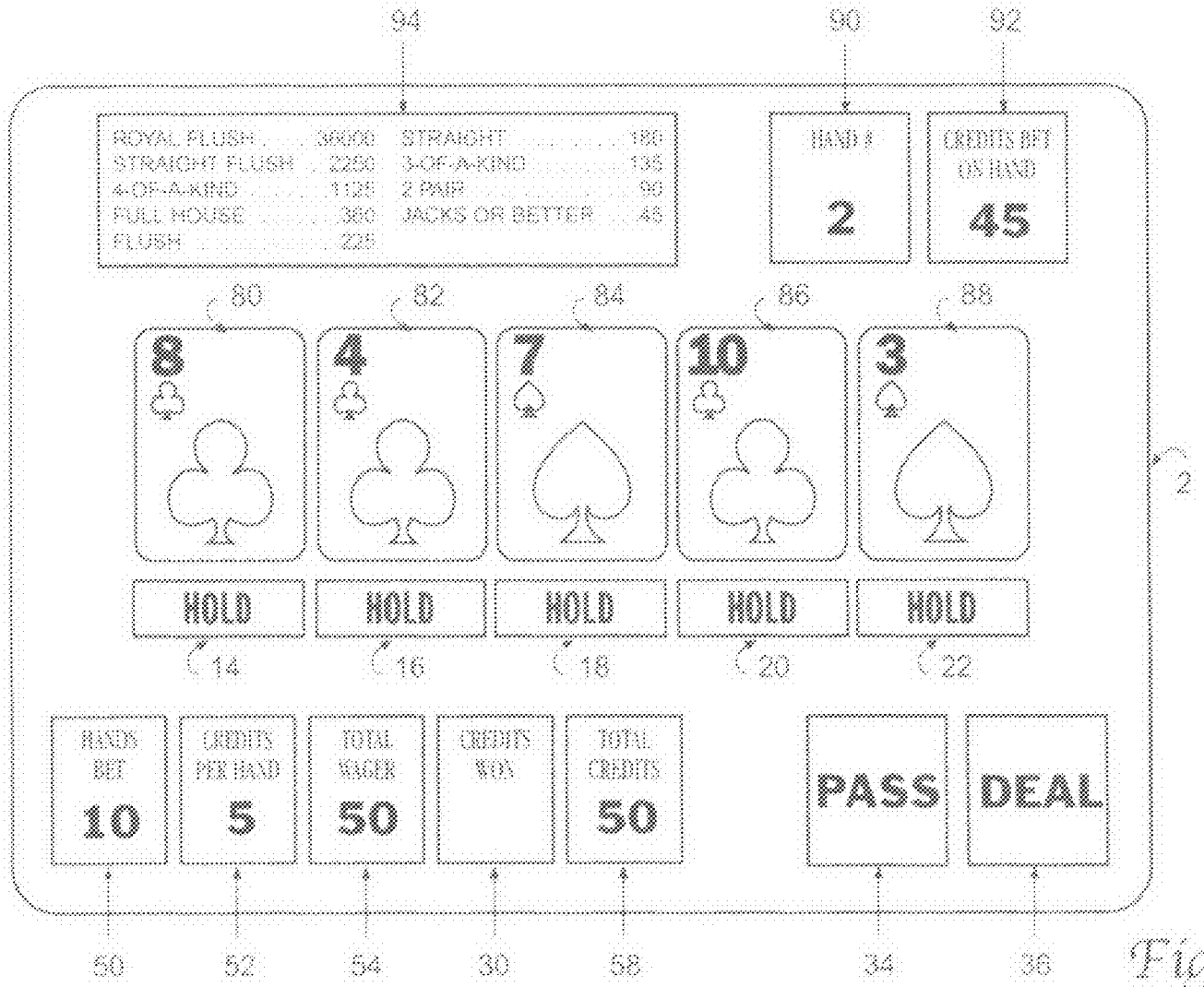
FIG. 4 shows the same game of FIG. 1 at a later stage.

FIG. 4 refers to the game elements shown in FIG. 3 with the automatic deal of a second 5 cards (80, 82, 84, 86, 88) from a separate deck of 52 playing cards. The new Hand # is displayed as 2 90, and the Credits Being Bet on this second hand are shown as 45 Credits 92. A new paytable 94 is shown, reflecting the payouts per 45-credit bet.

Figure 5:
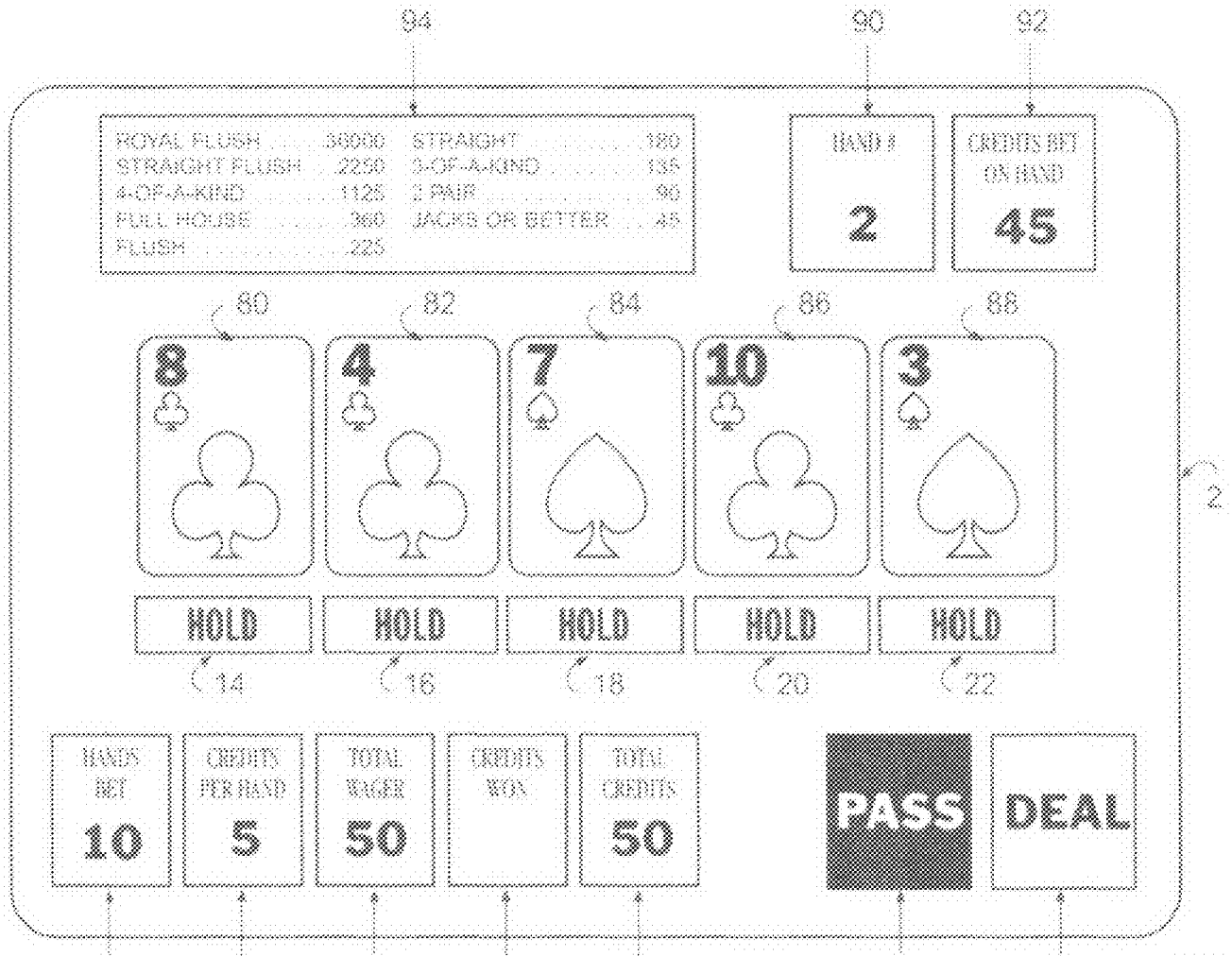
FIG. 5 shows the same game of FIG. 1 at a later stage.

FIG. 5 refers to the game elements shown in FIG. 4 with the PASS button being highlighted 96, indicating the player's choice to not play Hand #2 to a conclusion.

Figure 6:
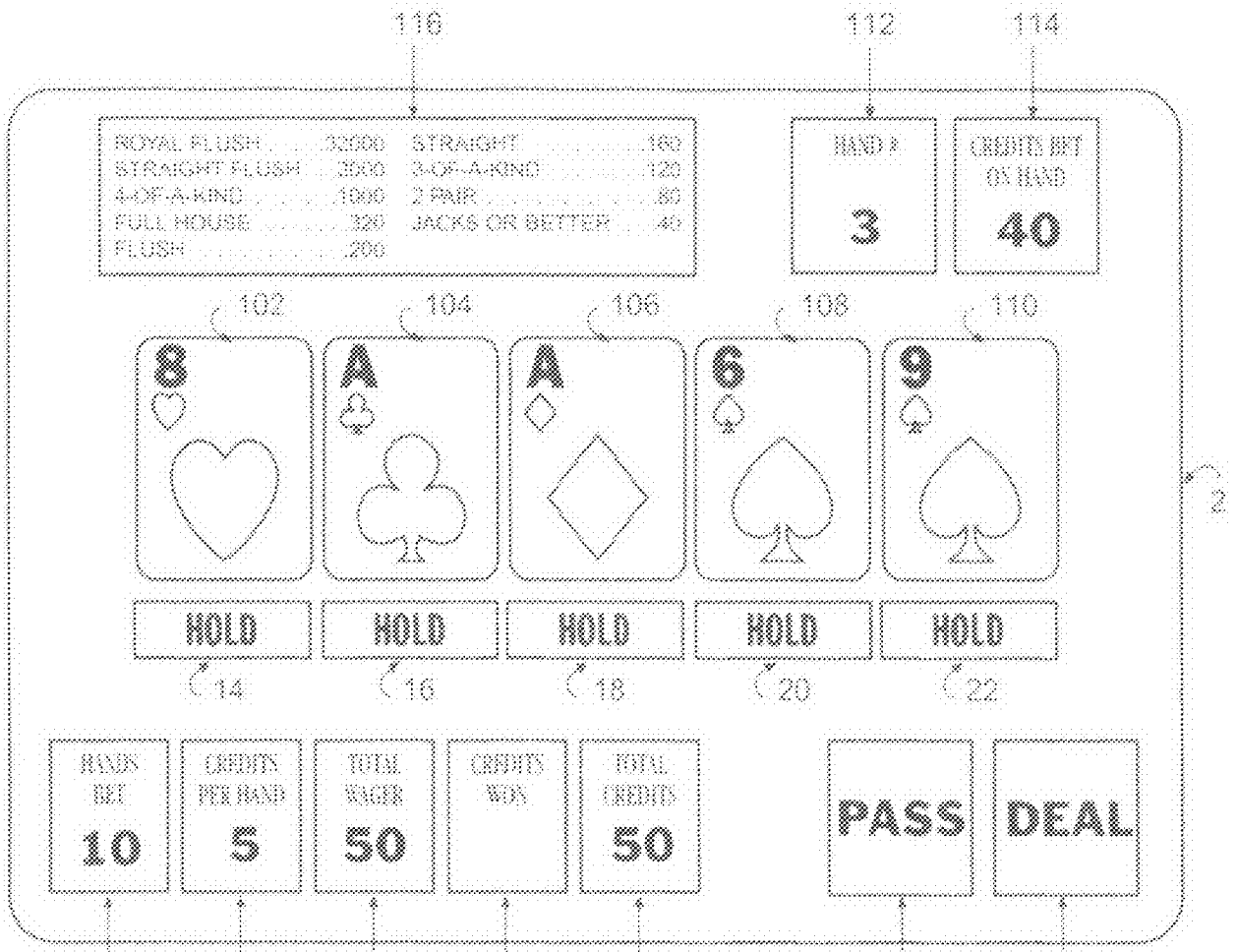
FIG. 6 shows the same game of FIG. 1 at a later stage.

FIG. 6 refers to the game elements shown in FIG. 5 with the automatic deal of a third 5 cards (102, 104, 106, 108, 110) from a separate deck of 52 playing cards. The new Hand # is displayed as 3 112, and the Credits Being Bet on this third hand are shown as 40 Credits 114. A new paytable 116 is shown, reflecting the payouts per 40-credit bet.

Figure 7:
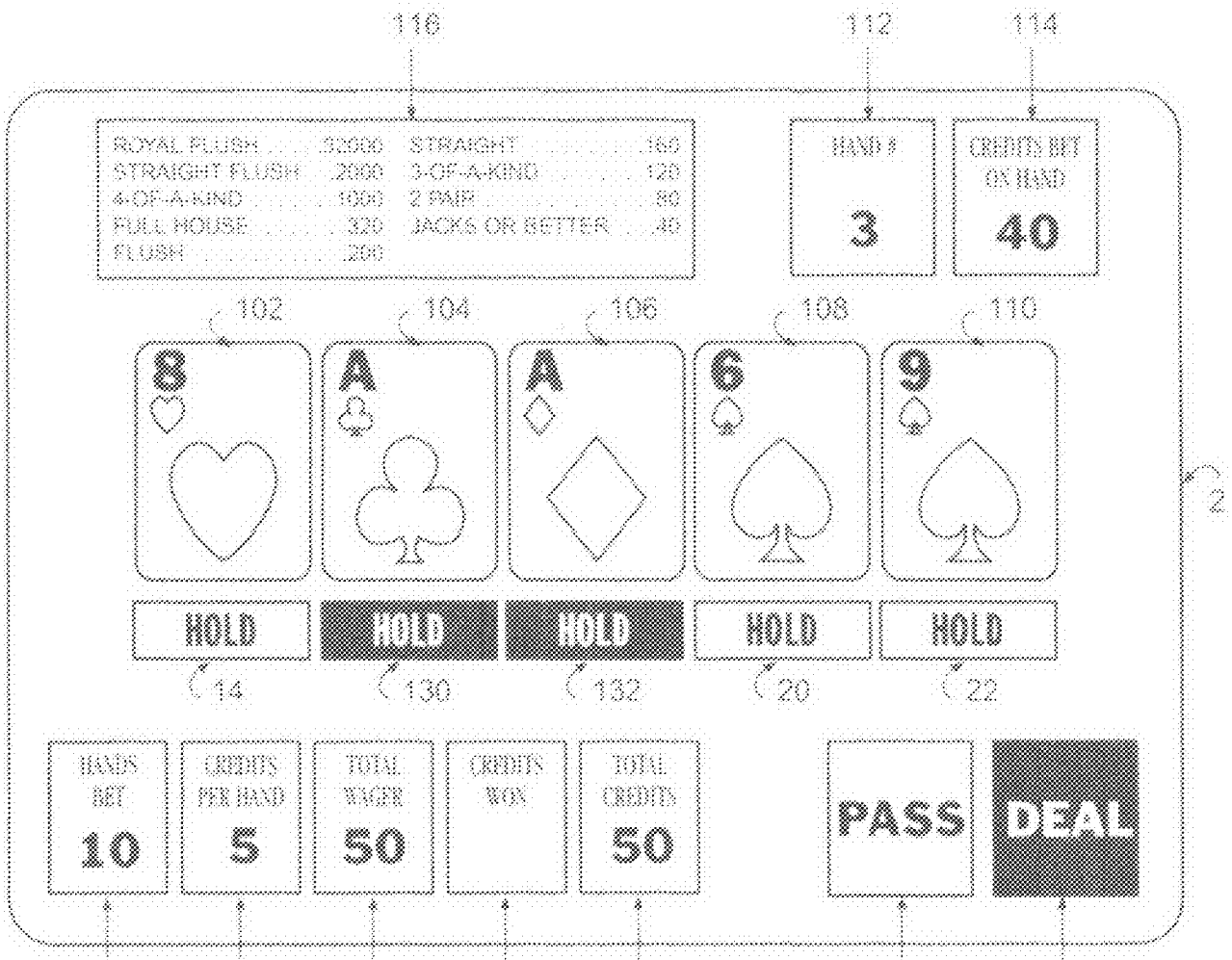
FIG. 7 shows the same game of FIG. 1 at a later stage.

FIG. 7 refers to the game elements shown in FIG. 6 and shows the player's choice to play out this third hand to its conclusion by pressing Hold buttons (130, 132) to hold the two Aces (104, 106), and pressing DEAL 120 to receive the draw cards from the remainder of the cards in this deck.

Figure 8:
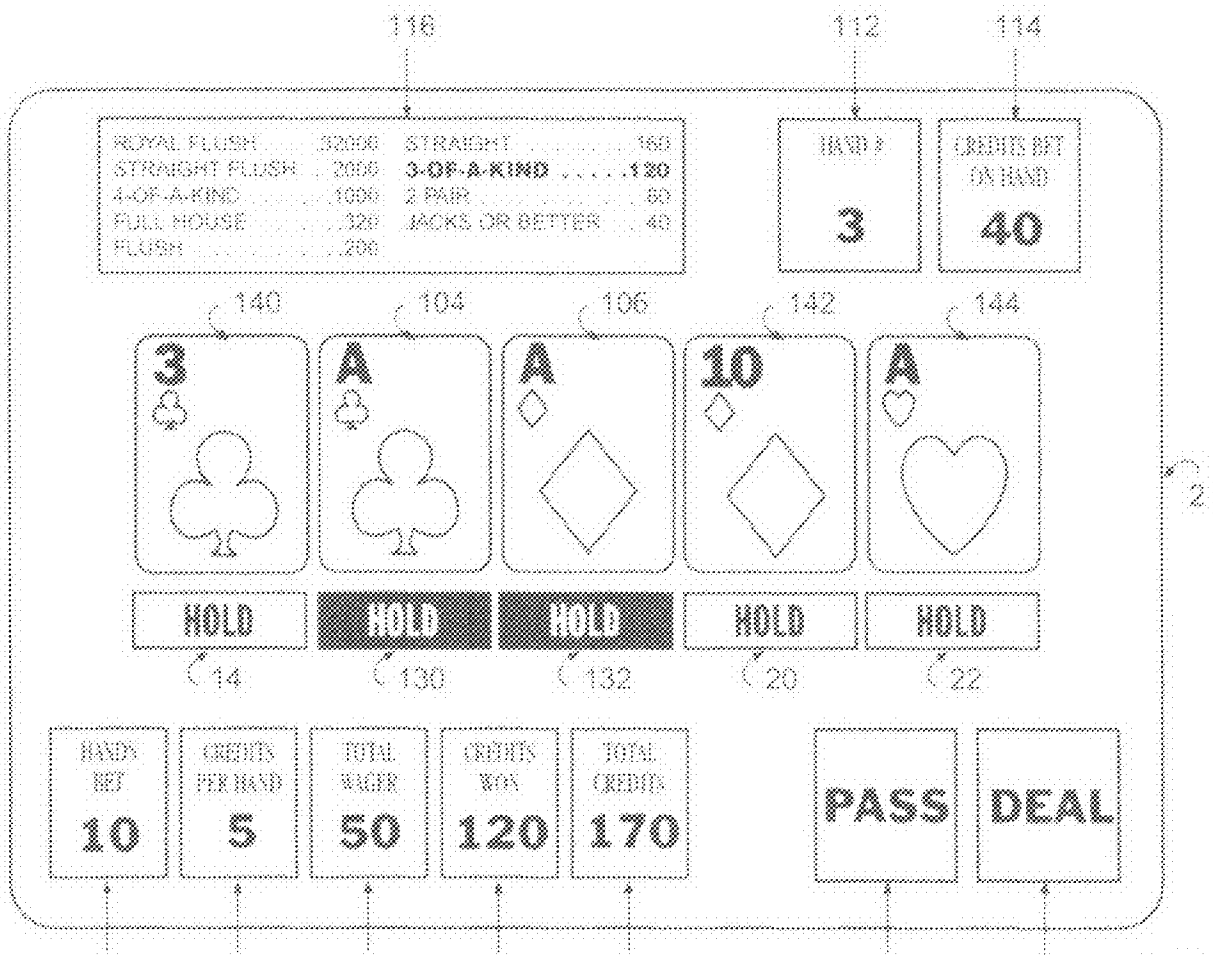
FIG. 8 shows the same game of FIG. 1 at a final stage.

FIG. 8 refers to the game elements shown in FIG. 7 and shows the draw of three cards (140, 142, 144) to complete the hand. The Win for the 3 Aces (104, 106, 144) is shown highlighted in the paytable 116, and the Win is displayed as 120 Credits Won 150, increasing the player's Total Credits to 170 160.

Figure 9:
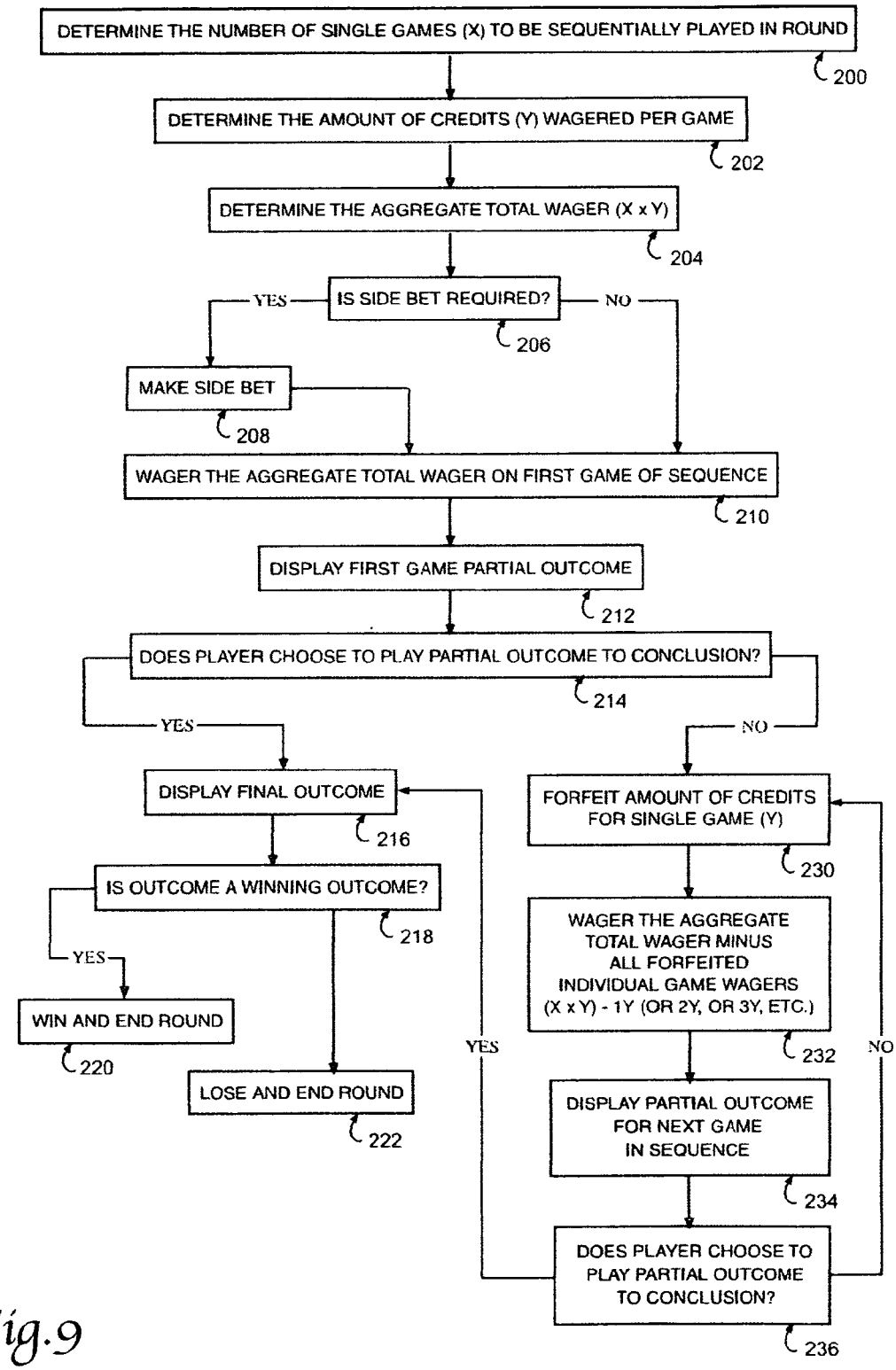
FIG. 9 shows a flow chart diagram of a methodology disclosed in the present invention.

FIG. 9 shows a flow chart diagram of one methodology disclosed in the present invention. The gameplay begins at Box 200, with the determination of the number of single games (X) to be played sequentially in the round. This may be a predetermined number, or the player may select the number. The next stage at Box 202 is the determination of the number of credits (Y) to be played per single game. The player may choose the number of credits to be wagered, or a predetermined or minimum or maximum amount may be required. Box 204 shows the determination of the Aggregate Total Wager, that is the Number of Games times the Amount of Credits Wagered per Game (X×Y). An additional Side Bet may be required, as shown in Box 206 and Box 208. Whether or not a side bet is required, the next stage of the methodology at Box 210 has the Aggregate Total Wager being wagered on the first game of the sequence in the round. The machine then displays a partial outcome of the game, as shown in Box 212. The partial outcome may be, but is not limited to, an initial deal of playing cards in video poker, a partial reel spin result in a slot game format, a partial outcome of a keno game in which less than all of the final machine-chosen numbers are initially displayed or a partial outcome of a bingo game in which less than all of the final machine-chosen numbers are initially displayed. After viewing the said partial outcome, the player is given the opportunity to either play the game to a conclusion, or pass on that first game (Box 214). If the player chooses to continue the game, by holding and drawing cards in video poker, for instance, a final outcome is displayed (Box 216). The final outcome is compared to a predetermined paytable, and a determination is made whether or not the final outcome is a winning outcome (Box 218). If the outcome is a winning outcome, the player is paid according to the predetermined paytable, and the round ends (Box 220). A losing result would also end the round, with the player losing the Aggregate Total Wager (Box 222). Referring back now to Box 214, if instead of continuing the first game to its conclusion, the player chooses to pass, the amount of credits (Y) wagered per game is forfeited (Box 230). Now the wager in play for the next sequential game is the Aggregate Total Wager minus all individual game wagers (Y) that have been forfeited. (Box 232). A partial outcome for this said next game is displayed (Box 234) and the player is again given the choice to either continue that said game to its conclusion (Boxes 216-222) or forfeit the amount of credits (Y) wagered on the single game (X) (Box 230). The methodology continues in the same fashion until a single game is played to its conclusion.

Although specific examples and specific images have been provided in this discussion, these specifics are intended to be only support for the generic concepts of the invention and are not intended to be absolute limits in the scope of the technology discussed.

What is claimed:

1. A wagering game system comprising:

a wager input for receiving an aggregate wager providing a set of a sequence of a number n of games to be played on the wagering game system;

at least one display to display a partial outcome of a first game of the n number of games; and a processor coupled to the wager input and the at least one display, the processor configured to:

offer a player an option of playing the first game to conclusion by wagering the entire aggregate wager on a final outcome of the first game or forfeiting a portion of the aggregate wager that is less than the entire aggregate wager; and providing a second partial outcome on a second game if the portion of the wager is forfeit while placing a remainder of the entire aggregate wager at potential risk in the second game or playing the first game to conclusion with the entire aggregate wager at risk.

2. The system of claim 1 wherein the number n of games is provided by an activity selected from the group consisting of an automatic selection of n games, the player selecting a number n of games, and the wagering game having a default number n.

3. The system of claim 1 wherein the wagering game is a poker game.

4. The system of claim 1 wherein the aggregate wager is apportioned equally among the n number of games.

5. The system of claim 4 wherein if the aggregate amount is Y, the portion that would be forfeit on the first game would be Y/n.

6. The system of claim 5 wherein the amount potentially at risk on a second game is Y−Y/n.

7. The system of claim 1 wherein the controller further offers the player the opportunity to place a side bet wager on at least one of the n games.

8. A gaming terminal for playing a sequence of wagering games, the gaming terminal comprising:

a wager input for receiving an aggregate wager providing a number n of games to be played on the wagering game system; and at least one display to display a partial outcome of a first game of the n number of games, the display offering a player an option of playing the first game to conclusion by wagering the entire aggregate wager on a final outcome of the first game or forfeiting a portion of the aggregate wager that is less than the entire aggregate wager and placing a remainder of the entire aggregate wager at potential risk in the second game and displaying a second partial outcome on a second game.

9. The gaming terminal of claim 8, wherein the number n of games is provided by an activity selected from the group consisting of an automatic selection of n games, the player selecting a number n of games, and the wagering game having a default number n.

10. The gaming terminal of claim 8, wherein the aggregate wager is apportioned equally among the n number of games.

11. The gaming terminal of claim 10 wherein if the aggregate amount is Y, the portion that would be forfeit on the first game would be Y/n.

12. A method of playing an electronic wagering game comprising:

receiving an aggregate wager from a player via a wager input device, the aggregate wager directed toward a sequence of a number n of games to be played on a wagering game system;

receiving a commitment to play a first game of the n number of games;

providing a partial outcome to the player on the first game via a processor;

providing the player an option of playing the first game to conclusion by wagering the entire aggregate wager on a final outcome of the first game or forfeiting a portion of the aggregate wager that is less than the entire aggregate wager; and providing a second partial outcome on a second game to the player if the portion of the wager is forfeited while placing a remainder of the aggregate wager at potential risk in the second game or playing the first game to conclusion with the entire aggregate wager at risk.

13. The method of claim 12 wherein the number n of games is provided by an activity selected from the group consisting of an automatic selection of n games, the player selecting a number n of games, and the electronic wagering game having a default number n.

14. The method of claim 12 wherein n is at least 2.

15. The method of claim 12 wherein the wagering game is a poker game.

16. The method of claim 12 wherein the aggregate wager is apportioned equally among the n number of games.

17. The method of claim 12 wherein if the aggregate amount is Y, the portion that would be forfeit on the first game would be Y/n.

18. The method of claim 17 wherein the amount potentially at risk on the second game is Y−Y/n.

19. The method of claim 12 further comprising offering the player a side bet wager on at least one of the n games.

* * * * *

UNITED STATES PATENT AND TRADEMARK OFFICE

CERTIFICATE OF CORRECTION

PATENT NO. : 8,235,783 B2
APPLICATION NO. : 12/008900
DATED : August 7, 2012
INVENTOR(S) : Kathleen Nylund Jackson It is certified that error appears in the above-identified patent and that said Letters Patent is hereby corrected as shown below:

On the Title page item [54] and column 1, line 1: Title: Replace Wagering Games Utilizing A Play or Pass Methodology Related Application Data *with* -- Wagering Games Utilizing A Play or Pass Methodology --

Signed and Sealed this
Nineteenth Day of March, 2013

Teresa Stanek Rea
*Acting Director of the United States Patent and Trademark Office*